US009573736B2

(12) United States Patent
Arch et al.

(10) Patent No.: US 9,573,736 B2
(45) Date of Patent: Feb. 21, 2017

(54) CONNECTOR ASSEMBLY FOR A SELF SEALING FITMENT

(71) Applicant: Scholle Corporation, Irvine, CA (US)

(72) Inventors: James J. Arch, Berkley, IL (US); Charles Thurman, Northlake, IL (US); David Bellmore, DeWitt, MI (US)

(73) Assignee: Scholle IPN Corporation, Northlake, IL (US)

( * ) Notice: Subject to any disclaimer, the term of this patent is extended or adjusted under 35 U.S.C. 154(b) by 0 days.

(21) Appl. No.: 14/324,036

(22) Filed: Jul. 3, 2014

(65) Prior Publication Data

US 2015/0028065 A1 Jan. 29, 2015

Related U.S. Application Data

(60) Provisional application No. 61/842,423, filed on Jul. 3, 2013.

(51) Int. Cl.
*B65D 25/48* (2006.01)
*B65D 47/06* (2006.01)

(52) U.S. Cl.
CPC ..... *B65D 47/068* (2013.01)

(58) Field of Classification Search
CPC ..... B65D 47/068; B65D 47/2031
USPC ..... 222/567, 501, 555, 545, 554, 571, 153.1,222/153.09, 538, 95, 375, 537, 153.01, 182,222/153.14, 562; 141/346; 215/247; 137/801, 137/377, 382, 798; 239/288.5, 397, 587.1; 251/128, 89; 138/96 R, 109, 177, 155; 285/80, 81, 33, 29, 35, 8
See application file for complete search history.

(56) References Cited

U.S. PATENT DOCUMENTS 193,174 A * 7/1877 Moss ..... F16L 37/05 137/798
1,787,488 A * 1/1931 McSpedon, Jr. ..... F16K 35/02 137/382
2,081,131 A * 5/1937 Barnes ..... B67D 1/0829 217/110
2,327,654 A * 8/1943 McIntosh ..... F16K 35/10 137/359
2,410,546 A * 11/1946 McCabe ..... F16K 7/20 137/377
2,566,878 A * 9/1951 Fahrenkrog ..... B05B 1/28 137/377
2,864,378 A * 12/1958 Schneller ..... F16L 35/00 138/109
3,349,969 A * 10/1967 Velt ..... B65D 83/40 220/260
3,970,284 A * 7/1976 Cobbe, Jr. ..... F16L 29/00 251/149.9

(Continued)

OTHER PUBLICATIONS

"Scholle QuickSeal Sentry SafeLock® Connector: How it Works". Scholle Packaging, (Sep. 23, 2013). Retrieved Sep. 26, 2015, from http://www.scholle.com/newsroom/video/scholle-sentry-safelock-connector-how-it-works.*

*Primary Examiner* — Kevin P Shaver
*Assistant Examiner* — Michael J Melaragno
(74) *Attorney, Agent, or Firm* — The Watson I.P. Group, PLC; Jovan N. Jovanovic; Vladan M. Vasiljevic

(57) ABSTRACT

A connector for a self sealing fitment that includes a body, a lower flange, and a locking mechanism. The connector is configured to sealingly engage with a cap coupled to a spout of a flexible bag by sealingly engaging with a sealing membrane of the cap. The locking mechanism facilitates the maintaining of the same in the inserted configuration. A lockout collar is provided to preclude inadvertent and undesirable coupling between a connector and a sealing membrane of a cap.

17 Claims, 15 Drawing Sheets

(56) References Cited

U.S. PATENT DOCUMENTS 4,301,828 A * 11/1981 Martin, Jr. ..... B60K 15/05 137/381
4,330,070 A * 5/1982 Doubleday ..... G01F 11/023 222/287
4,353,488 A * 10/1982 Schneiter ..... B67D 3/045 222/501
4,375,864 A * 3/1983 Savage ..... B65D 77/067 141/349
4,457,445 A * 7/1984 Hanks ..... B65D 55/06 220/214
RE32,354 E * 2/1987 Savage ..... B65D 77/067 141/349
4,709,835 A * 12/1987 Kruger ..... B67D 3/0003 222/541.6
5,238,141 A * 8/1993 Callegari ..... F17C 13/002 137/382
5,238,221 A * 8/1993 Schwaderer ..... F16L 37/084 251/354
5,467,806 A * 11/1995 Stricklin ..... F16L 37/28 137/614.04
5,727,714 A * 3/1998 Fawcett ..... A45F 3/16 222/175
5,816,298 A * 10/1998 Stricklin ..... F16L 41/16 137/614.04
5,839,614 A * 11/1998 Brown ..... B65D 47/2031 220/89.1
6,126,045 A * 10/2000 Last ..... B65D 41/02 137/614.2
6,155,465 A * 12/2000 Steiger ..... B67D 3/043 222/501
6,244,469 B1 * 6/2001 Knickerbocker ... B05B 11/3011 222/153.14
6,257,626 B1 * 7/2001 Campau ..... F16L 37/0985 285/319
6,371,340 B1 * 4/2002 Pateman ..... B65D 47/2031 222/494
6,378,730 B1 * 4/2002 Reddy ..... B67B 7/26 222/541.9
6,612,545 B1 * 9/2003 Rutter ..... F16L 41/02 141/346
6,644,367 B1 * 11/2003 Savage ..... B65D 77/067 137/614.04
6,871,679 B2 * 3/2005 Last ..... B65D 75/5877 137/614.05
6,962,321 B1 * 11/2005 Savage ..... B65D 77/067 137/614.04
6,981,534 B2 * 1/2006 Williams ..... B65B 3/045 141/346
7,044,339 B1 * 5/2006 Kuo ..... B05B 11/3059 222/182
7,357,277 B2 * 4/2008 Verespej ..... B65D 47/0814 222/153.01
7,387,220 B2 * 6/2008 Verespej ..... B65D 47/0814 220/254.1
7,607,555 B2 * 10/2009 Smith ..... B65D 77/067 215/257
8,091,727 B2 * 1/2012 Domkowski ..... A61J 1/1406 215/251
8,505,188 B2 * 8/2013 Lenz ..... B65D 47/0838 215/243
8,640,931 B2 * 2/2014 O'Keefe, Jr. ..... B67D 1/0004 222/501
8,733,600 B2 * 5/2014 Pritchard ..... B65D 47/103 222/494
D737,928 S * 9/2015 Nunez ..... B05B 1/28 D23/214
2004/0232175 A1 * 11/2004 deCler ..... B65D 5/746 222/567
2005/0087563 A1 * 4/2005 Ciavarella ..... A47K 5/1204 222/321.9
2005/0184105 A1 * 8/2005 Johnson ..... B67D 7/005 222/568
2007/0295765 A1 * 12/2007 Bull ..... B65D 47/2031 222/494
2009/0196677 A1 * 8/2009 Wright ..... A45D 34/00 401/264
2009/0212078 A1 * 8/2009 Gaus ..... B65D 47/2031 222/490
2009/0302073 A1 * 12/2009 McKeown ..... A47K 5/122 222/571
2010/0089921 A1 * 4/2010 Ellenkamp-Van Olst ..... B65D 47/0809 220/254.3
2010/0133273 A1 * 6/2010 Thurman ..... B65D 47/0838 220/260
2010/0176151 A1 * 7/2010 Johnson ..... B65D 77/067 222/92
2010/0176152 A1 * 7/2010 Johnson ..... B65D 75/5877 222/92
2011/0079300 A1 * 4/2011 Kneer ..... B65D 47/18 137/511
2011/0272405 A1 * 11/2011 Thurman ..... B65D 47/0838 220/260
2012/0318824 A1 * 12/2012 McKenna ..... B65D 77/067 222/185.1
2013/0043280 A1 * 2/2013 Hagleitner ..... A47K 5/1208 222/207
2013/0048638 A1 * 2/2013 Fox ..... B65D 47/2031 220/284
2014/0117044 A1 * 5/2014 Pappalardo ..... B05C 17/00553 222/137
2014/0209644 A1 * 7/2014 Socier ..... B65D 47/2031 222/494
2014/0224356 A1 * 8/2014 Hatton ..... B65D 47/2031 137/522
2015/0028065 A1 * 1/2015 Arch ..... B65D 47/068 222/567

* cited by examiner

CONNECTOR ASSEMBLY FOR A SELF SEALING FITMENT

CROSS-REFERENCE TO RELATED APPLICATION

This application claims priority from U.S. Provisional Patent Application Ser. No. 61/842,423 entitled Self Sealing Bag in Box Cap Assembly, filed Jul. 3, 2013, the entire specification of which is hereby incorporated by reference in its entirety.

BACKGROUND OF THE DISCLOSURE

1. Field of the Disclosure

The invention relates in general to packaging and dispensing equipment, and more particularly, to a connector assembly for a self sealing fitment. While not limited thereto, the connector assembly for a self sealing fitment is particularly well suited for use in association with flexible packaging of flowable material, including but not limited to bag in box packaging.

2. Background Art

This application incorporates by reference U.S. patent application Ser. No. 13/100,271 filed May 3, 2011 which is a continuation in part of U.S. patent application Ser. No. 12/589,368 filed Oct. 22, 2009, entitled "Self Sealing Bag in Box Cap Assembly," which claims priority from U.S. Pat. App. Ser. No. 61/196,969, filed Oct. 22, 2008, entitled "Self Sealing Bag in Box Cap Assembly", and, U.S. patent application Ser. No. 29/383,152 filed Jan. 13, 2011, entitled "Self Sealing Bag in Box Cap Assembly".

Self sealing bags have become increasingly useful, especially in the food packaging industry. One current system utilizes a flexible bag having a spout to which a Sentry cap available from Scholle Corporation is affixed. A separate hose is provided which has at a first end a probe and at a second end a connector available from Erie Plastics with a flexible membrane. One such membrane is available from LMS of Midland, Mich. The probe is inserted into the opening of the Sentry cap and the other end is affixed to a distribution hose so that flowable material can be withdrawn from the flexible bag through the Sentry Cap and to the distribution hose. One such system is shown in FIG. 1 of the incorporated '271 application. Several different embodiments of such a cap are shown in U.S. Pat. No. 7,387,220 issued to Verespej et al and assigned to Scholle Corporation and U.S. Pat. No. 7,357,277 issued to Verespej et al and assigned to Scholle Corporation. Both of these patents are incorporated by reference herein, in their entirety.

Among other drawbacks, such a system requires many separate components which increase the cost of use of such a system. Additionally, with such a system, many connections are utilized, each of which is susceptible to failure. Further still, such sealing membranes are prone to damage during the insertion of the probe therein, and there are drawbacks associated with the membrane configurations themselves.

Further still, there have been drawbacks with the different connectors that can be utilized in association with such sealing membranes. Among other drawbacks, the use of the same connector for a number of different packages can lead to inadvertent coupling of a bag to a wrong connector. In addition, some of the connectors allow for relative movement of the sealing membrane and the connector such that the integrity of the seal is challenged.

SUMMARY OF THE DISCLOSURE

The disclosure is directed to a connector for a self sealing fitment comprising a body, a lower flange and a locking mechanism. The body has a first elongated portion and a second elongated portion, each having an inner passageway. The inner passageways are in fluid communication with each other. The first elongated portion has a proximal end that meets with a proximal end of the second elongated portion. The second elongated portion has an outer surface. The elongated portion extends to a distal end. The lower flange is disposed on the outer surface of the second elongated portion. The lower flange is spaced apart from the distal end. The lower flange defines the insertion portion of the second elongated portion as the region extending from the lower flange to the distal end. The locking mechanism has a central pivot beam extending outwardly from the second elongated portion between the proximal end and the lower flange. A movable portion extends from the central pivot beam in a first direction toward the proximal end of the second elongated portion defining a handle portion. Likewise, the movable portion extends in a second direction toward the distal end of the second elongated portion defining an engaging portion. Both the handle portion and the engaging portion having an inner surface facing and spaced apart from the second elongated portion, with an inward flange positioned at a distal end of the cap engaging portion. Upon insertion of the connector into a cap, the insertion portion extends through a sealing membrane of a cap, with the inward flange cooperatively engaging a portion of the cap to preclude inadvertent detachment of the connector from within a cap.

In some configurations, the insertion portion of the outer surface of the second elongated portion has a substantially uniformly smooth surface configuration structurally configured to sealingly engage a sealing membrane of a cap.

In some configurations, the insertion portion of the outer surface of the second elongated portion is free of resilient sealing members or o-rings.

In some configurations, the lower flange includes a bottom surface, which shape matingly corresponds to an opening in a cap, to, in turn, maintain a desired central positioning of the second elongated portion within a sealing membrane.

In some configurations, the first elongated portion and the second elongated portion are substantially perpendicular to each other.

In some configurations, the connector is a single integrally molded member. In some such configurations, the single integrally molded member comprises a uniform material therethrough.

In some configurations, the lower flange includes a bottom surface that is substantially perpendicular to the second elongated portion.

In some configurations, the locking mechanism further includes a pivot stop positioned between the central pivot beam and the proximal end of the second elongated portion. The pivot stop precluding further pivoting of the central pivot beam relative to the second elongated member.

In some configurations, the connector includes a lockout collar having a radially outward portion extending radially outward from the second elongated portion proximate the lower flange. An extension portion extends from the radially outward portion in an annular configuration around at least a portion of the second elongated portion in a direction toward the distal end of the second elongated portion.

In some configurations, the body further includes an upper flange spaced apart from the lower flange toward the proximal end of the second elongated portion. A channel is defined between the upper flange and the lower flange. The lockout collar further includes a connector body coupling member extending from the radially outward portion. The connector body coupling member is configured to releasably engage with the second elongated portion within the channel defined between the upper flange and the lower flange.

In some configurations, the extension portion extends arcuately approximately 180° about the second elongated portion.

In some configurations, the extension portion is substantially parallel with the second elongated portion.

In some configurations, the extension portion extends beyond the distal end of the second elongated portion.

In some configurations, the connector includes a valve positioned within the second inner passageway.

In some configurations, the valve comprises a duck bill valve. A clamping member is attachable to the distal end of second elongated portion. Upon attachment, the clamping member and the distal end sandwich a portion of the duck bill valve therebetween, to in turn, fix the position of the valve within the second elongated portion.

In some embodiments, the clamping member includes a interfacing tab. The distal end of the second elongated portion includes an interfacing tab as well. The interfacing tab of the clamping member and the interfacing tab of the second elongated portion are configured for coupling with each other.

BRIEF DESCRIPTION OF THE DRAWINGS

The disclosure will now be described with reference to the drawings wherein.

DETAILED DESCRIPTION OF THE DISCLOSURE

Figure 1:
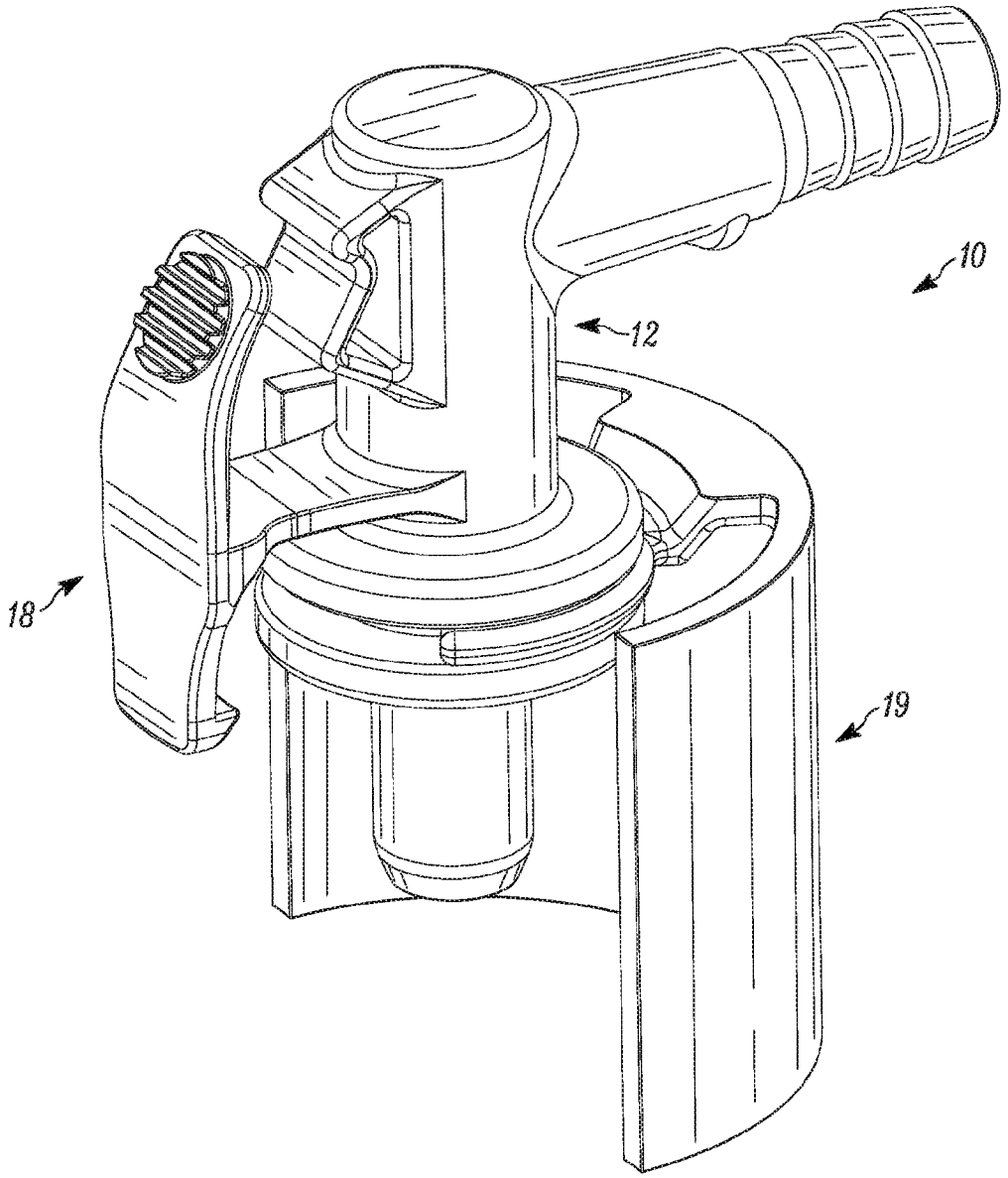
FIG. 1 of the drawings is a perspective view of a connector assembly for a self sealing fitment of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the connector assembly for a self sealing fitment is shown generally at 10. The fitment, which will be described below is typically coupled to a spout (which will also be described below with reference to FIGS. 8 and 9) sealed to a flexible bag. While not limited thereto, and as will be set forth below, the flexible bag typically includes a plurality of panels that are sealed together through a plurality of seals to define a fluid tight cavity, with the spout providing ingress thereinto. The flexible bag may be positioned within a rigid outer container prior to dispensing, or during dispensing. At times, such a rigid outer container and inner flexible bag may cooperatively define a bag in box package. The flexible bag typically is configured for receiving and dispensing a flowable material such as a liquid, syrup, gel, puree, suspension and the like. The disclosure is not limited to any particular flowable material, to any particular configuration of a flexible bag or spout.

The connector includes a body 12, an upper flange 14, a lower flange 16, a locking mechanism 18 and a lock out collar 19. In the configuration shown in FIG. 1, the foregoing components with the exception of the lock out collar 19 comprise a monolithic integrally formed member with the lock out collar comprising a separate member that can be releasably attached to the monolithic integrally formed member. Indeed, in such a configuration, the connector may be formed from a single material. In another configuration, such as the configuration shown in FIG. 7, all of the foregoing components are found on a monolithic integrally formed member.

Figure 2:
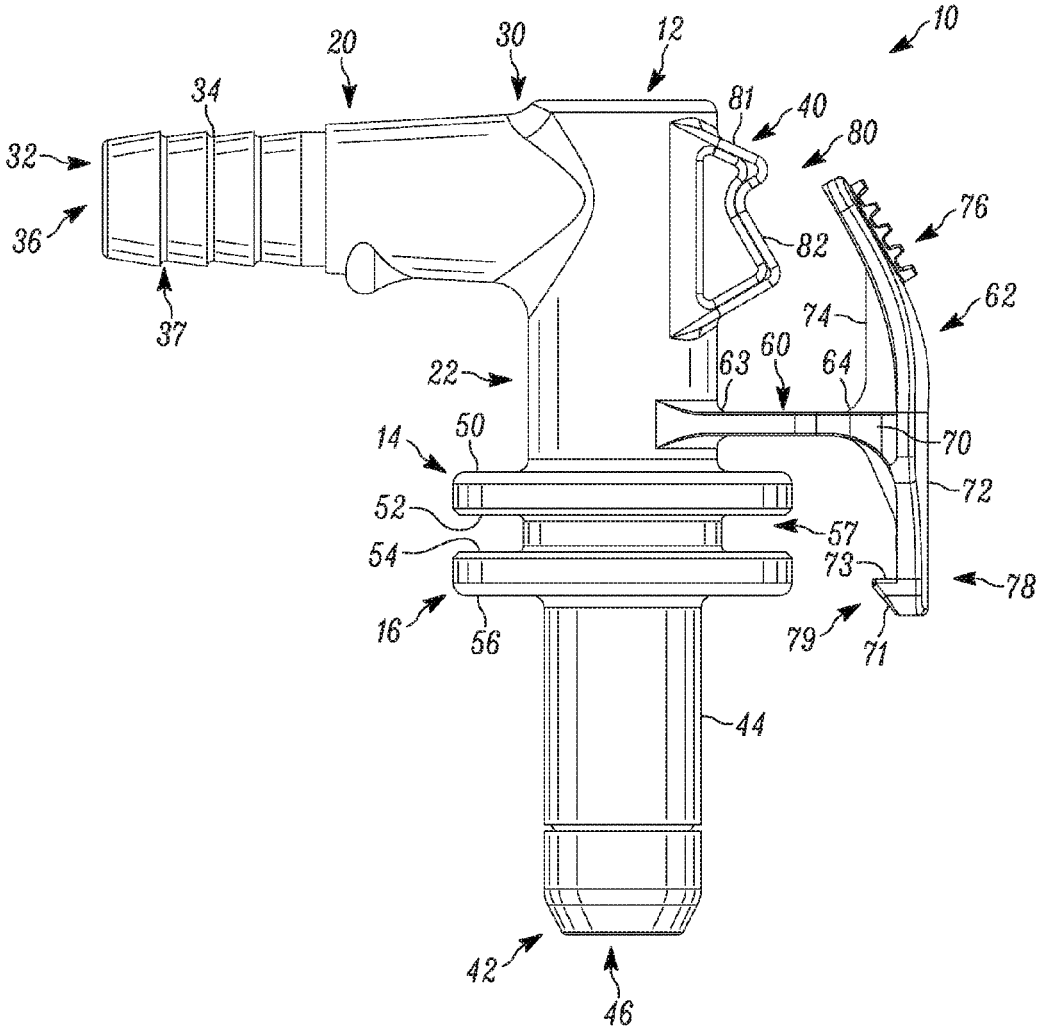
FIG. 2 of the drawings is a side elevational view of a portion of the connector assembly, showing, in particular the body, flanges, and locking mechanism, with the lockout collar removed.
Figure 3:
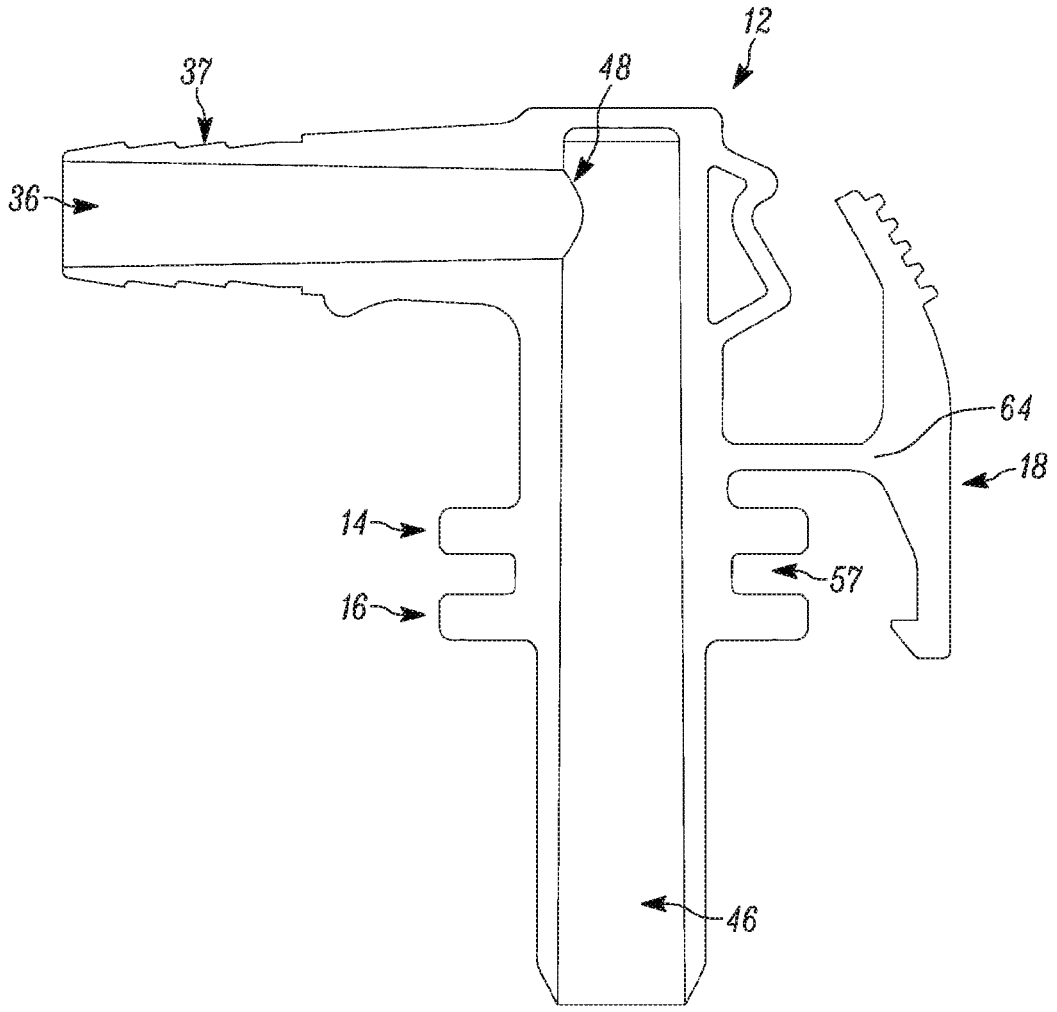
FIG. 3 of the drawings is a cross-sectional view of a portion of the connector assembly, showing, in particular, the first and second inner passageways as well as the intersection therebetween.

The body 12 is shown in FIGS. 2 and 3 as comprising first elongated portion 20 and second elongated portion 22. The first elongated portion 20 and the second elongated portion 22 are disposed at an angle relative to each other. In the configuration shown, the two elongated portions are positioned in a generally perpendicular configuration, while in other embodiments, the two elongated portions may be positioned at an oblique angle relative to each other.

The first elongated portion 20 includes proximal end 30 and distal end 32. The proximal end 30 extends from the second elongated portion 22 and the distal end 32 is generally spaced apart therefrom. The first elongated portion 20 includes outer surface 34 and inner passageway 36. The outer surface 34 is tapered inwardly between the proximal end and the distal end, with the distal end of the outer surface 34 including a barbed region 37 having a plurality of barbs for coupling with an outside hose (not shown). The inner passageway 36 comprises a passageway generally tapered in the opposite direction, or substantially uniform. Generally, the thinnest portion of the first elongated portion is at the distal end thereof.

The second elongated portion 22 includes proximal end 40, distal end 42, outer surface 44 and second inner passageway 46. The second elongated portion 22 is substantially uniformly cylindrical with the second inner passageway being of a substantially uniform cross-section therealong. The first and second inner passageways meet at intersection 48 and are in a generally unobstructed fluid engagement.

Figure 4:
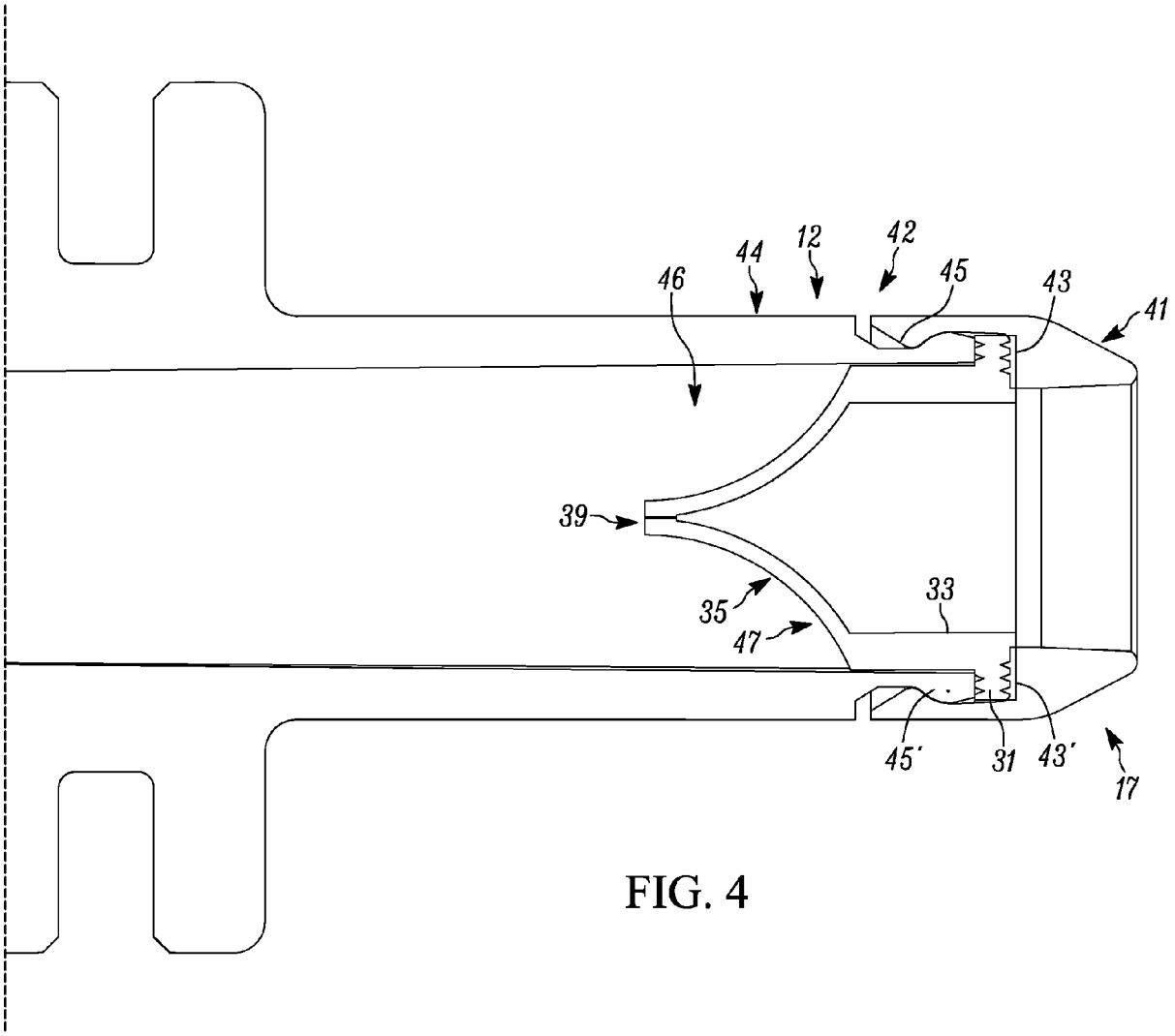
FIG. 4 of the drawings is a cross-sectional view of a configuration of the connector assembly, showing, in particular, a valve positioned within the second inner passageway.

In the embodiment shown in FIG. 4, the second elongated portion may include a valve assembly 17 positioned therein. The valve may comprise a duckbill valve having an opening. More particularly, the valve assembly 17 includes a clamp member 41 and a duckbill valve 47. The clamp member 41 comprises a body that substantially matches the second elongated portion at the distal end thereof, and includes clamp surface 43 and interfacing tab 45. The distal end 42 of the second elongated portion 22 includes clamp surface 43' and interfacing tab 45'. As will be explained, the interfacing tab 45 and the interfacing tab 45' cooperate to lock the clamp member 41 in operable engagement with the distal end of the second elongated portion.

The duckbill valve 47 is shown in FIG. 4 as comprising flange 31, cylindrical body 33, duckbill portion 35 and opening 39. The flange 31 includes opposing surfaces, one of which interfaces with the clamp surface 43 and the other of which interfaces with the clamp surface 43'. When positioned in operable engagement the two clamp surfaces sandwich the flange 31 therebetween in engagement which maintains the duckbill valve in the retained configuration. It will be understood that the force to open the opening 39 by fluid directed from the distal end toward the proximal end is substantially less than the force to open the opening 39 by fluid directed from the proximal end toward the distal end. In the latter direction, the fluid itself urges the opening 39 into a closed orientation.

Referring again to FIGS. 2 and 3, the upper flange 14 and the lower flange 16 are disposed along the outer surface 44 of the second elongated portion 22. The upper flange 14 includes top surface 50 and bottom surface 52. The lower flange 16 includes top surface 54 and bottom surface 56. The two flanges are separated from each other so as to define a channel 57 therebetween. In the embodiment shown, the two flanges are generally parallel to each other and generally perpendicular to the outer surface of the second elongated portion to which they are attached.

As will be explained below, the bottom surface 56 of the lower flange 16 engages with the fitment, with the portion of the second elongated portion 22 therebelow being defined as the inserted portion, with the portion thereabove being defined as the non-inserted portion. The inserted portion is generally substantially uniform and substantially uniformly cylindrical. It will be understood that due to the nature of the self sealing valve of the fitment, a smooth surface is preferred. In addition, the inserted portion is generally free of seals, resilient members or other anomalies, rather, the sealing is accomplished by the generally rigid structure of the inserted portion and the flexible nature of the self sealing valve.

It will be understood that in certain embodiments, the upper flange may be eliminated, and thus leaving only the lower flange. It will also be understood that the lower flange may have a top surface that is tapered into the outer surface thereby eliminating the top surface. It will further be understood that the bottom surface 56 of the lower flange may include surface configurations which facilitate the proper positioning of the flange in the proper orientation. That is, in the embodiment disclosed, the diameter and shape of the lower flange are such that they occupy a space within the fitment above the seal to locate the second elongated portion generally centrally within the fitment. As such, the lower flange 16 is generally a uniform circular member centered about the second elongated portion. Additionally, while the flanges are shown as being solid structures, it is contemplated that the flanges may include openings, or may comprise a hoop with a plurality of spokes extending between the hoop and the outer surface of the second elongated portion.

The locking mechanism 18 is shown in FIGS. 2 and 3 as comprising central pivot beam 60 and movable portion 62. The central pivot beam 60 includes proximal end 63 and distal end 64. The central pivot beam 60 is generally perpendicular to the second inner passageway and has a width and a thickness, with the width being greater than the thickness, such that pivoting in a plane toward and away from the distal end 42 of the second elongated portion requires less force than pivoting in a direction that is perpendicular to the second inner passageway. In the embodiment shown, the ratio of the width to the thickness is greater than 2:1 and more preferably 6:1. The thickness is such that manipulation of the movable portion can be achieved with the desired amount of pressure applied by a person (that is, sufficient force to allow for pivoting while precluding undesirable movement).

The movable portion 62 includes engagement joint 70, outer surface 72, and inner surface 74. The central pivot beam 60 meets the movable portion at the engagement joint. The movable portion 62 generally lies in line with the second inner passageway so as to be generally parallel thereto. The handle portion 76 extends from the engagement joint toward the proximal end 40 of the second elongated portion. A gripping region may be positioned on the outer surface 72 of the handle portion to provide enhanced interaction with the fingers of the user.

The cap engaging portion 78 extends from the engagement joint 70 toward the distal end 42 of the second elongated portion. An inwardly directing flange 79 is positioned at a distal end of the cap engaging portion. It will be understood that the outer surface 71 of the inwardly directing flange is inclined or angled whereas the inner surface 73 of the inwardly directing flange is generally perpendicular to the inner surface. Thus, while a force imparted on the outer surface 71 will direct the pivoting of the movable portion to direct the cap engaging portion outwardly away from the second elongated portion, a similar force in an opposing direction imparted on the inner surface 73 provides no such pivoting. As such, the inward flange 79 provides a one way mechanism to allow a portion of the fitment to extend beyond the inward flange 79 toward the central pivot beam while precluding disconnecting and removal therefrom.

A pivot stop 80 is positioned on the outer surface 44 of the second elongated portion 22 in a position that corresponds to the direction of pivoting of the handle portion 76 toward the proximal end 40 of the second elongated portion. The pivot stop 80 provides a limiter that precludes further pivoting of the handle portion, while also providing feedback to the user that the movable portion 62 has pivoted sufficiently to allow for the disconnecting of the inward flange 79 relative to the cap. The pivot stop 80 includes shelf 81 and base 82. When the movable portion reaches the end of pivoting, the outer surface 72 of the handle portion 76 of the movable portion 62 is generally coplanar with the shelf 81. At the same time, the inner surface 74 of the movable portion abuts and contacts the base 82 of the pivot stop. Thus, the base 82 precludes further movement, while the substantial coplanar configuration of the outer surface and the shelf provide a tactile feedback to the user that the end of travel has been reached, and that the inward flange 79 is out of the way so that removal can be facilitated.

Figure 5:
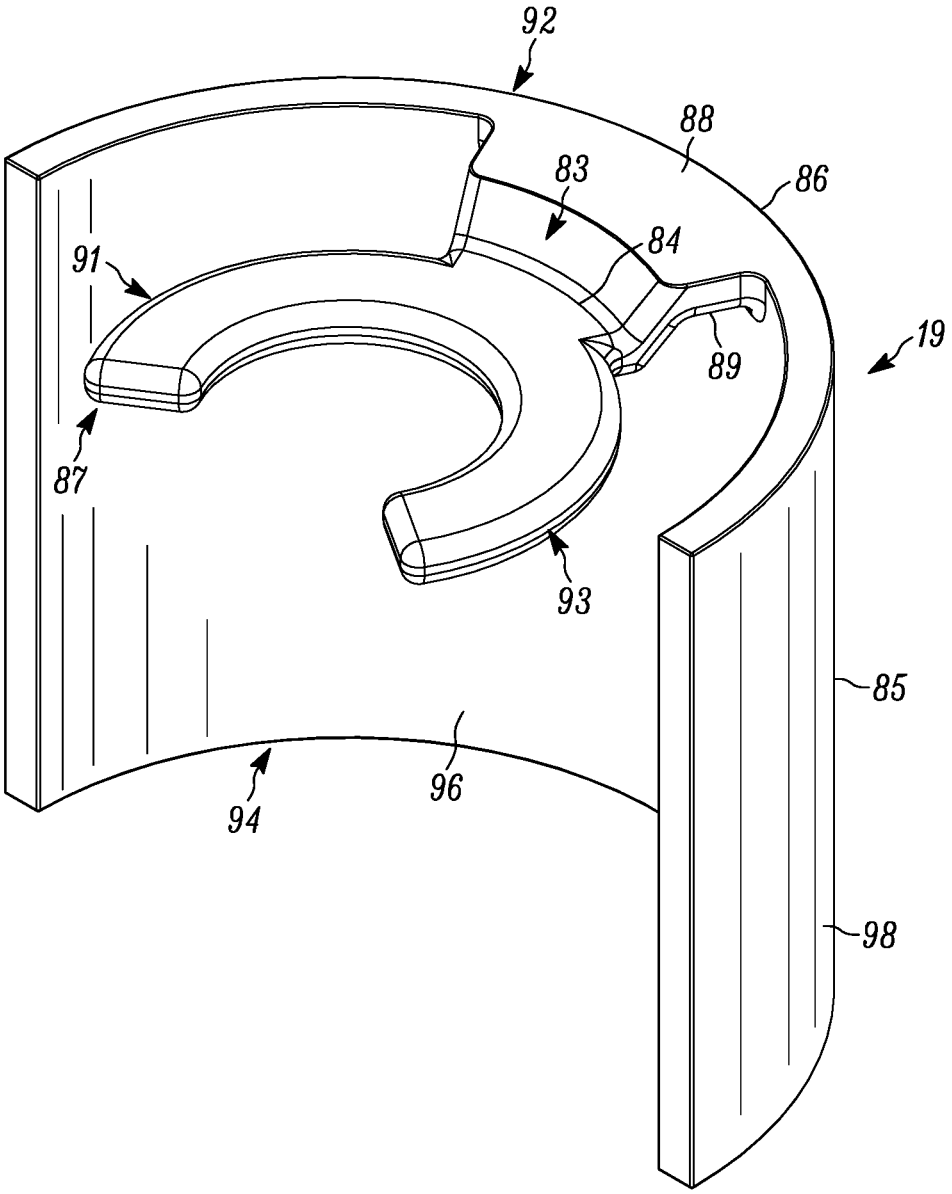
FIG. 5 of the drawings is a perspective view of the lockout collar of the preset disclosure.
Figure 6:
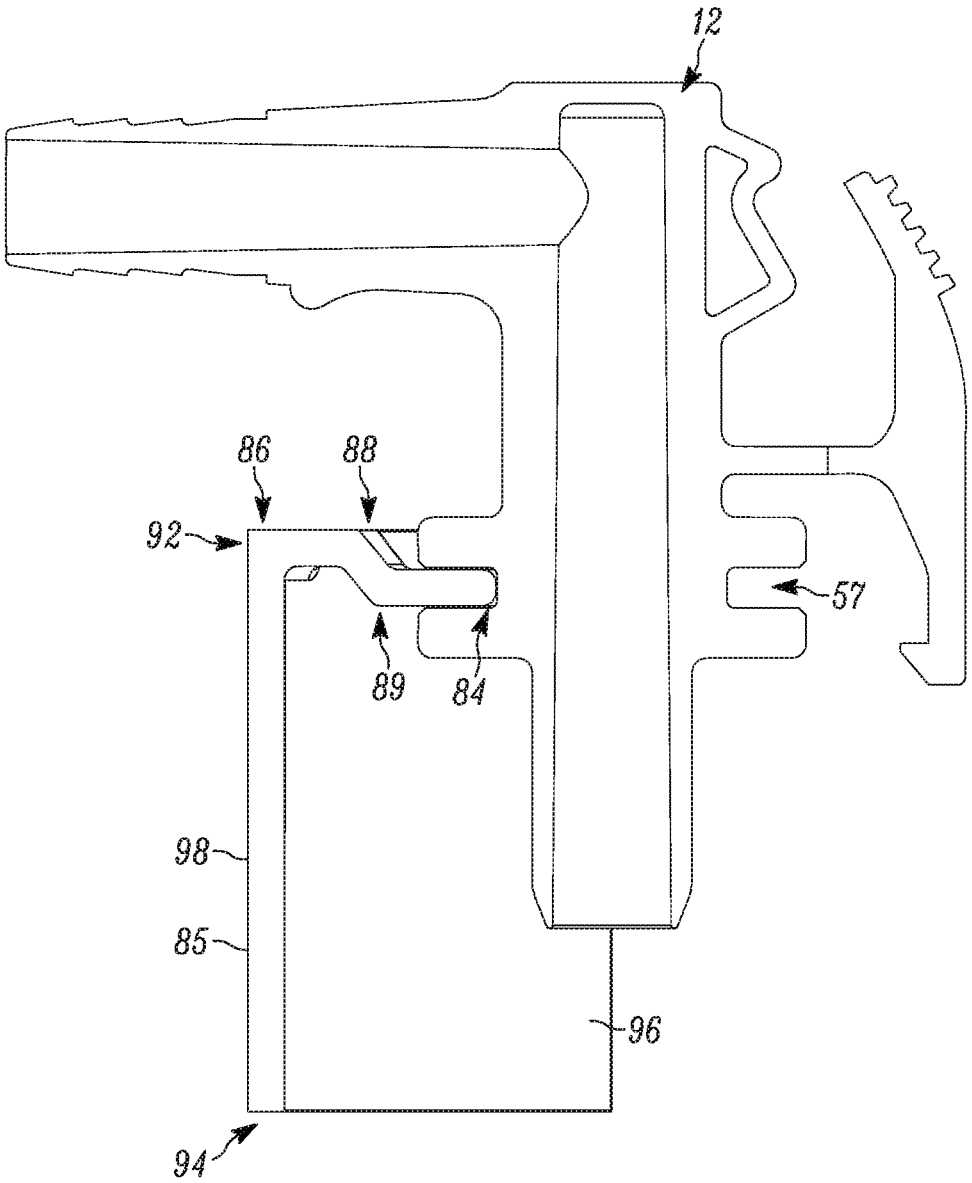
FIG. 6 of the drawings is a cross-sectional view of the connector assembly, showing, in particular, the coupling of the lockout collar and the body of the connector assembly.

The lockout collar is shown in FIGS. 5 and 6 as comprising radially outward portion 83, extension portion 85 and connector body coupling member 87. In the configuration shown, the lockout collar is formed from a single injection molded member. In other configurations, the lockout collar may be formed from a plurality of components. The radially outward portion includes inner end 84, outer end 86, upper surface 88 and lower surface 89. The radially outward portion may be in a single plane or may include several separate panels which are oblique to each other. In the embodiment shown, the radially outward portion comprises an arcuate member defined by an included angle of between 20° and 60°. It is contemplated that the radially outward portion comprises an arcuate member defined by an included angle that corresponds to that of the extension portion. In other embodiments, multiple separate radially outward portions may be provided that extend outwardly to the extension portion.

The extension portion 85 is shown in FIGS. 5 and 6 as comprising proximal end 92, distal end 94, inner surface 96 and outer surface 98. In the embodiment shown, the extension portion comprises an elongated arcuate member that has a length and is defined by an arcuate distance of approximately 180°. In the configuration shown, the extension portion is of a substantially uniform thickness and has a diameter which is centered about the second elongated portion when installed (and about the connector body coupling member 87). In the configuration shown, the length of the extension portion depends on the configuration of the spout and the fitment relative to the insertion portion of the connector body to which it is attached.

As can be seen in FIGS. 5 and 6, the extension portion is coupled to the outer end 86 of the radially outward portion. In the configuration shown, the extension portion extends to either side of the radially outward portion and the radially outward portion is generally centered. Whereas the radially outward portion extends outward radially the extension portion is generally parallel to the second elongated portion when installed.

The connector body coupling member 87 is shown in FIG. 5 as comprising first grasping arm 91 and second grasping arm 93. The grasping arms extend from the inner end 84 of the radially outward portion and are configured with an inner surface that can releasably engage in the channel 57 between the upper and lower flanges 14, 16 (see FIG. 2 and FIG. 3). As will be understood the grasping arms define an inner surface that corresponds to the configuration of the channel 57, such that the arms can exert an inward biasing force. The arms comprise a resilient material that when inserted allows the arms to outwardly move to be positioned within the channel, and once positioned, return inwardly to fit within the channel 57. The reverse steps can be undertaken to separate the lockout collar from the body of the connector assembly.

Figure 7:
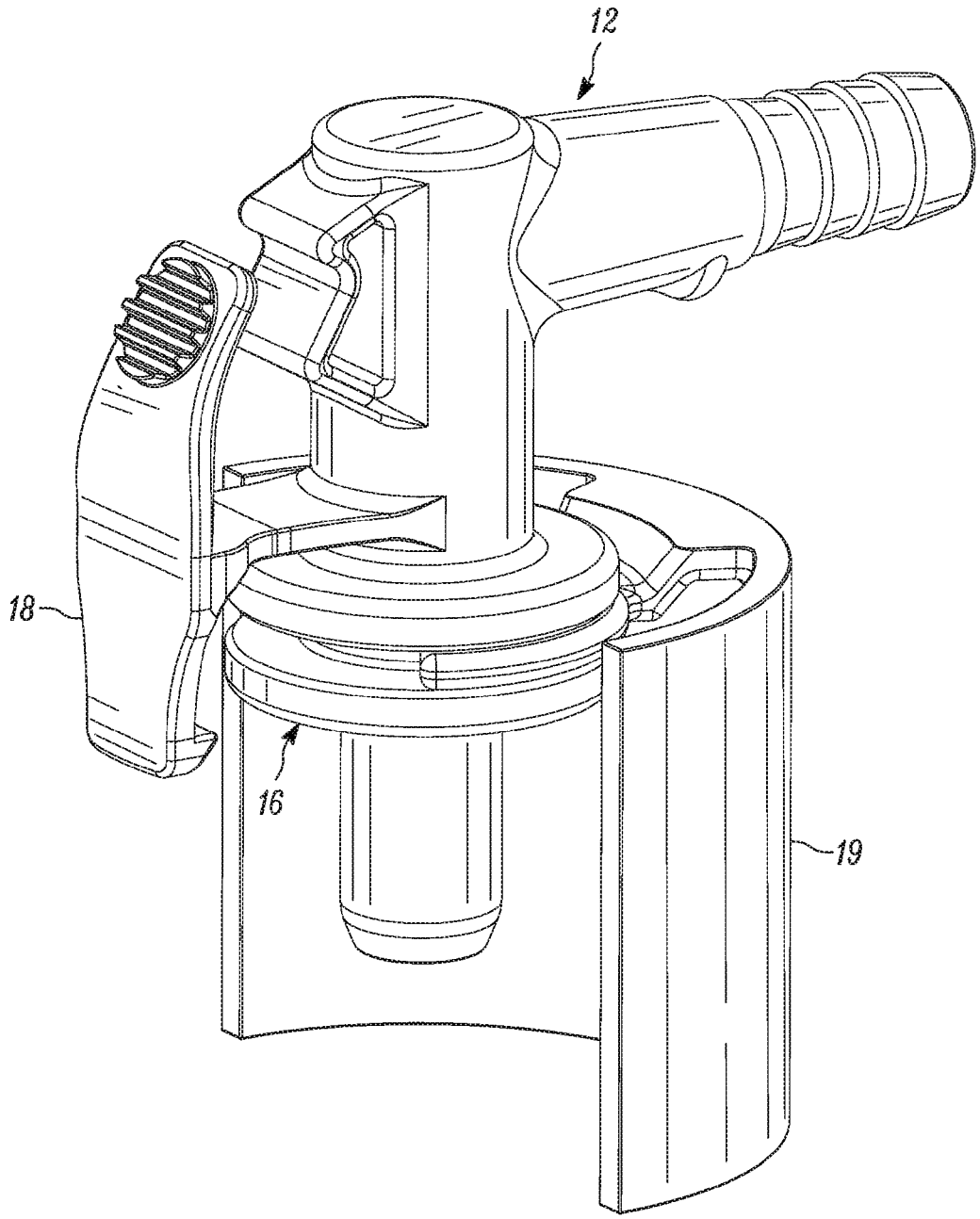
FIG. 7 of the drawings is a perspective view of another configuration of the connector assembly, showing, in particular, a configuration wherein the lockout collar is integrally formed with the body of the connector assembly.

In other embodiments, as set forth above, and as is shown in FIG. 7, the connector body coupling member can be omitted, and the lockout collar 19 can be integrally formed with the lower flange 16 or the upper flange 14 which is integrally molded with the body 12.

Figure 8:
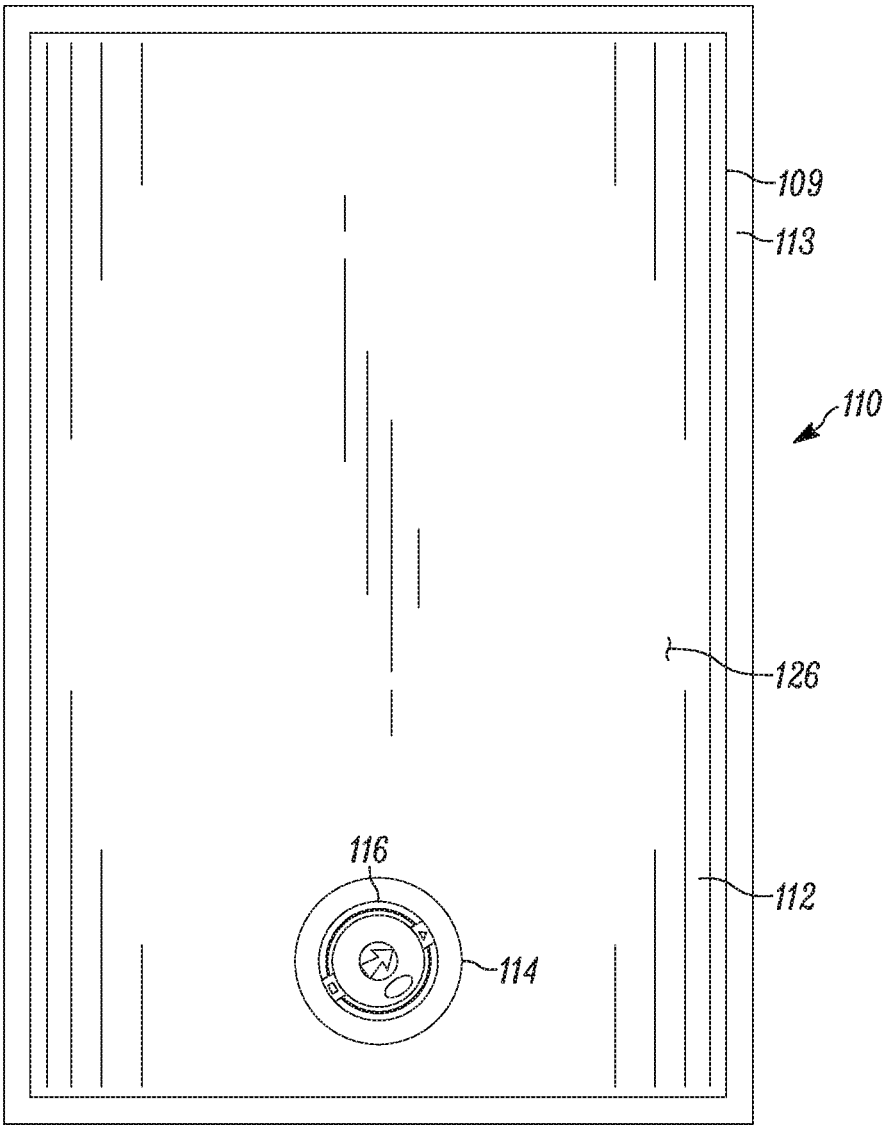
FIG. 8 of the drawings is a top plan view of a container having a spout with a self sealing fitment assembly mounted thereto.
Figure 9:
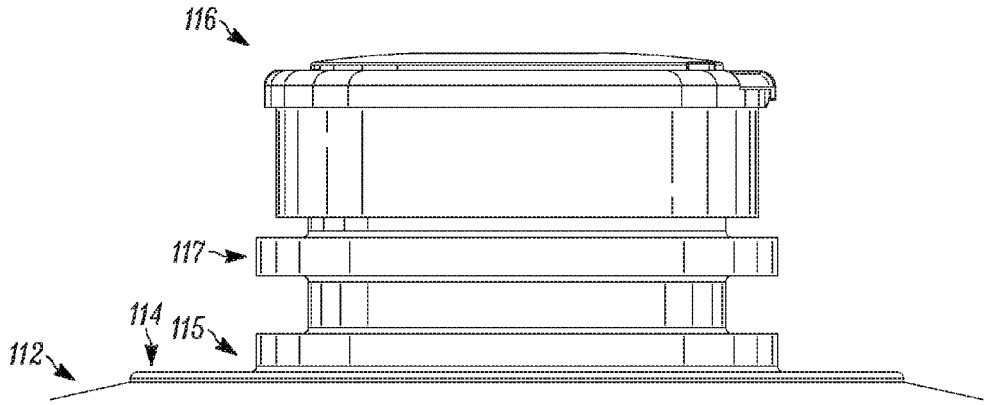
FIG. 9 of the drawings is a side elevational view of the spout and the cap assembly with which the connector assembly of the present disclosure can be utilized.

The operation of such a connector assembly for a self sealing fitment/cap will be described with respect to a flexible bag having a spout and a self sealing fitment/cap. Referring now to FIGS. 8 and 9, container assembly 110 includes container body (flexible bag) 112, spout 114 and fitment/cap assembly 116. The container body 112 comprises a plurality of flexible polymer panels 113 and a plurality of seals 109 coupling the panels to each other. The panels and seals cooperate to define cavity 126. Of course, the invention is not limited to any particular number of panels and/or seals, or, a container body having any particular geometric configuration. For example, the container body may comprise a pillow-type container, or may comprise a gusseted container, among others. Such container assemblies are commonly utilized with a number of different types of flowable material. For example, syrups, purees, smoothies, pastes and other materials may be utilized in association with the container. The disclosure is certainly not limited to any particular flowable material. The flexible bag is often positioned within an outer rigid container and a probe is directed through the fitment. One particular use is with thicker beverage mixes or syrups and associated filling equipment.

An exemplary spout 114 is shown in FIG. 9 as comprising a body, base flange 115, and grasping flange 117. The base flange extends from the body. The base flange is larger than the opening on the bag, such that the panel surrounding the opening is welded to the base flange, providing a substantially fluid tight connection. The grasping flange 117 may comprise one of what may be a plurality of separate flanges which are configured for grasping and retaining of the spout by filling equipment, and for retention by other containers in which the container assembly is positioned (i.e., retention of a box of a bag in box container assembly). The spout may comprise a HDPE material, or a polypropylene material, among others. Again, the invention is not limited to use with any particular spout, or any particular configuration of a spout, or with a spout formed from any particular material.

Figure 10:
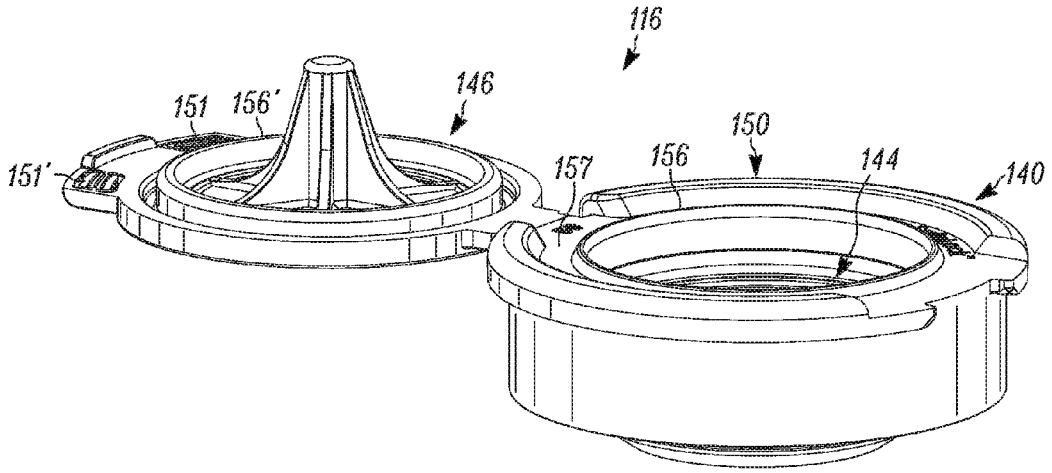
FIG. 10 of the drawings is a perspective view of the cap assembly, showing, in particular, the cap assembly in an open configuration.
Figure 11:
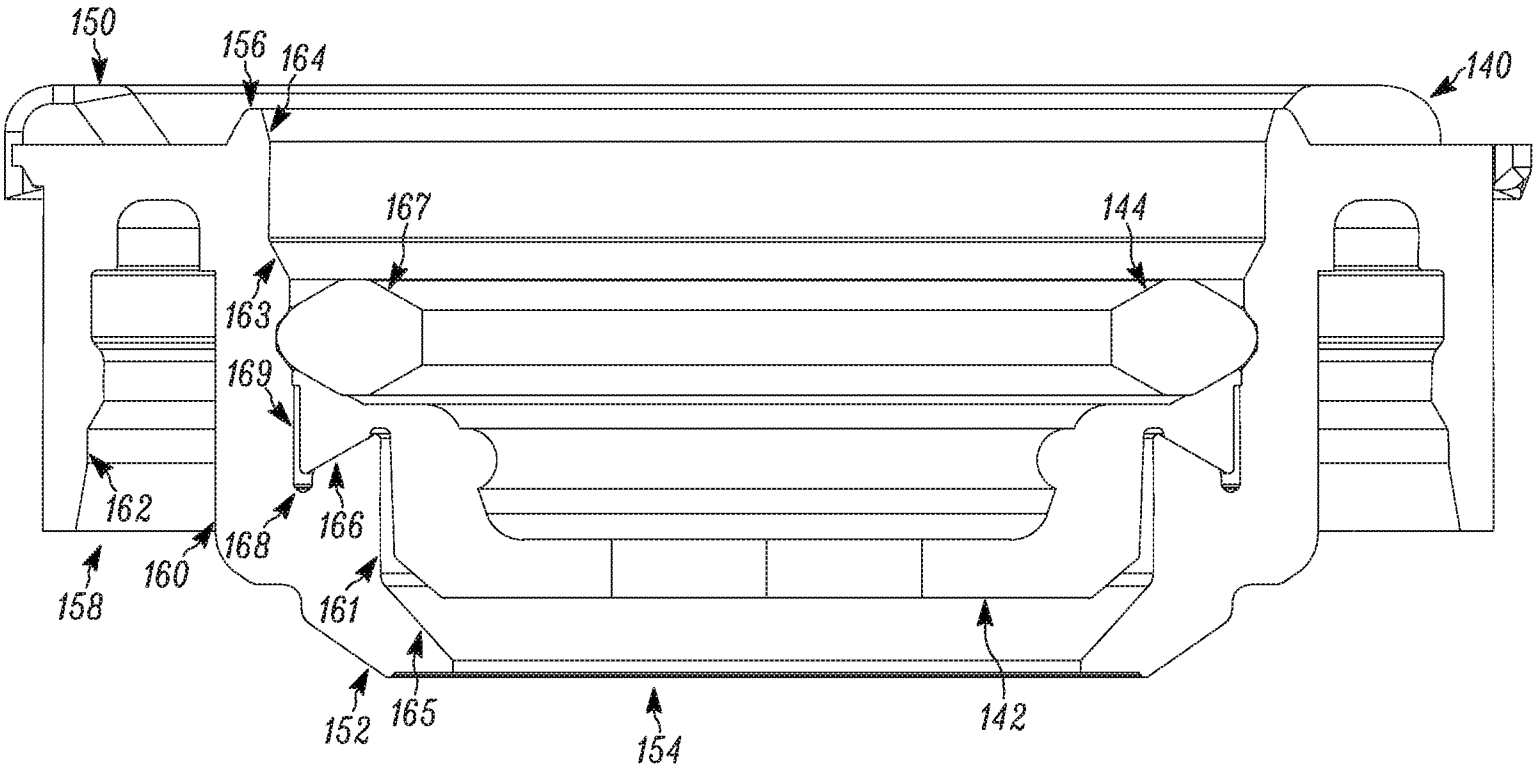
FIG. 11 of the drawings is a cross-sectional view of the cap assembly with the omission of the cap 46, showing, in particular, the placement of the sealing membrane and the retaining ring.

An exemplary cap assembly 116 is shown in each of FIGS. 10 and 11 as comprising body 140, sealing membrane 142 (FIG. 11 only), retaining ring 144 (FIG. 11) and cap/seal 146. The body 140 includes top surface 150, bottom surface 152 and opening 154. Generally, the body and the cap may be integrally molded (much like the Sentry product sold by Scholle Corporation). The sealing membrane and the retaining ring comprise separate elements which are coupled to the base. In certain embodiments, the cap may be omitted, and a membrane seal (formed from a foil or a polymer film) can be sealingly engaged with the top surface 150 of the body. This membrane is frangible and pierced prior to or simultaneous with insertion of a drain or probe into the opening 154 of the cap assembly. Typically, the base and cap, as well as the ring are formed from a polymer, such as HDPE, or polypropylene, although other materials are likewise contemplated.

With reference to FIG. 10, the top surface 150 includes circumferential cap sealing flange 156. The circumferential cap sealing flange 156 is typically employed when cap 146 is utilized. The cap 146 includes a similar sealing flange 156' which together with the cap sealing flange 156 provides a hermetic seal when engaged. In embodiments wherein a membrane seal is utilized, the sealing flange 156 can be omitted, and the membrane seal can be sealed against the circumferential sealing surface 157 which is outboard of the location of the cap sealing flange. Additionally, tamper evident structures, such as structures 151, 151' may be provided on the cap.

With reference to FIG. 11, the bottom surface 152 of the body 140 further includes spout engagement channel 158 which is configured to engage and retain a spout, such as spout 114 of the container 110. Generally, the seal is hermetic and results from the elastic deformation of each of the spout and the channel 158. The channel 158 is defined by inner circumferential flange 160 and outer circumferential flange 162 which are concentrically positioned with respect to the opening and with respect to each other. It will be understood that in many embodiments, the inner circumferential flange 160 forms the outer wall of the opening 154. In other embodiments, the outer wall of the opening may comprise a separate structure that is spaced apart from (but preferably concentric with) the circumferential flanges 160, 162.

Figure 12:
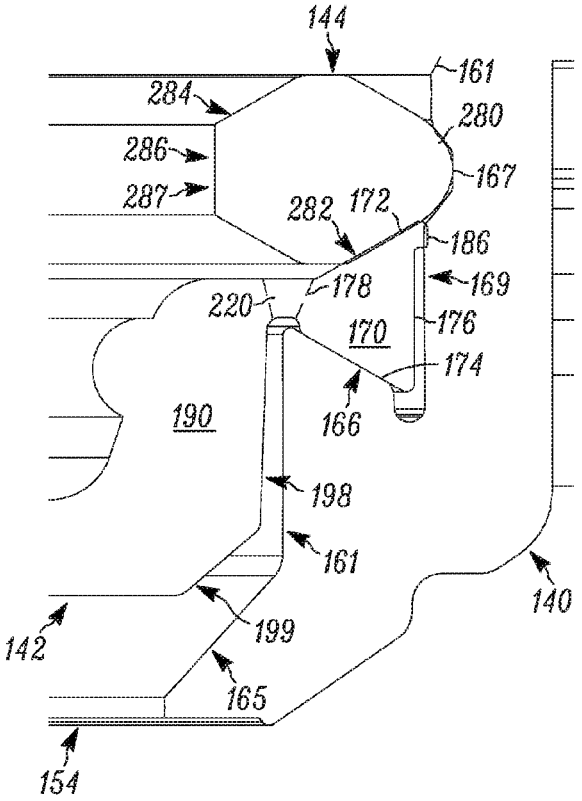
FIG. 12 of the drawings is a partial cross-sectional view of the cap assembly, showing, in particular, the placement of the sealing membrane and the retaining ring.

With reference to FIGS. 11 and 12, opening 154 is shown as including (i.e., being defined by) inner surface 164 and membrane engaging flange 166 positioned at the lower end thereof. The inner surface 164 includes a recessed circumferential channel 167, a base channel 168 and a membrane engaging surface between the recessed circumferential channel 167 and the base channel 168. In the embodiment shown, the membrane engaging flange 166 is angled so that the surface of the flange is at an acute angle with the membrane engagement surface 169. Of course, this is exemplary and not to be deemed limiting. Additionally, an inwardly sloping guide wall portion 163 may be circumferentially disposed above the recessed circumferential channel so as to direct a probe inwardly toward the membrane above the position of the retaining ring when the retaining ring is in its operable position. Similarly, an upper inwardly sloping lower guide wall portion 165 extends from a depending region 161 of the membrane engaging flange 166 and directs the membrane, and in turn, the probe toward the center of the opening. It has been found that such a portion 165 greatly limits damage to the membrane caused by the probe entering in a less than ideal location.

Figure 13:
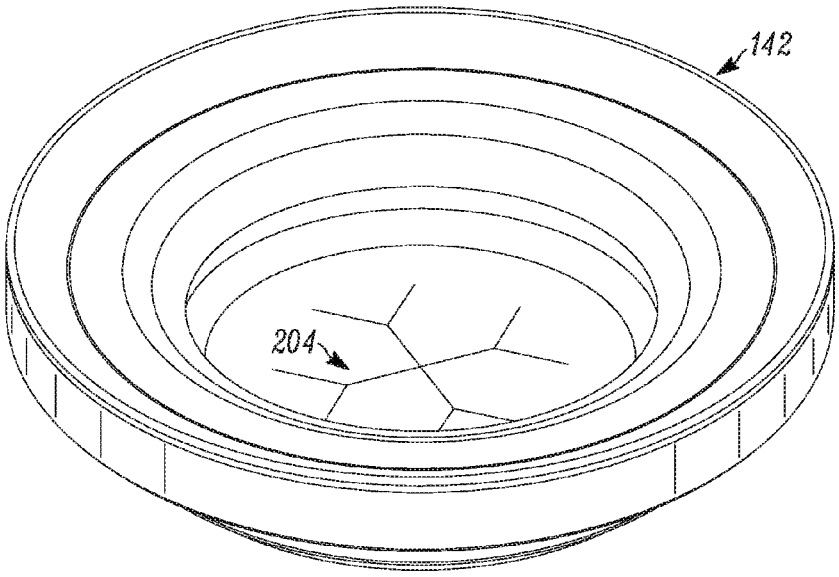
FIG. 13 of the drawings is a perspective view of the sealing membrane of the present disclosure, showing, in particular, the valve opening.
Figure 14:
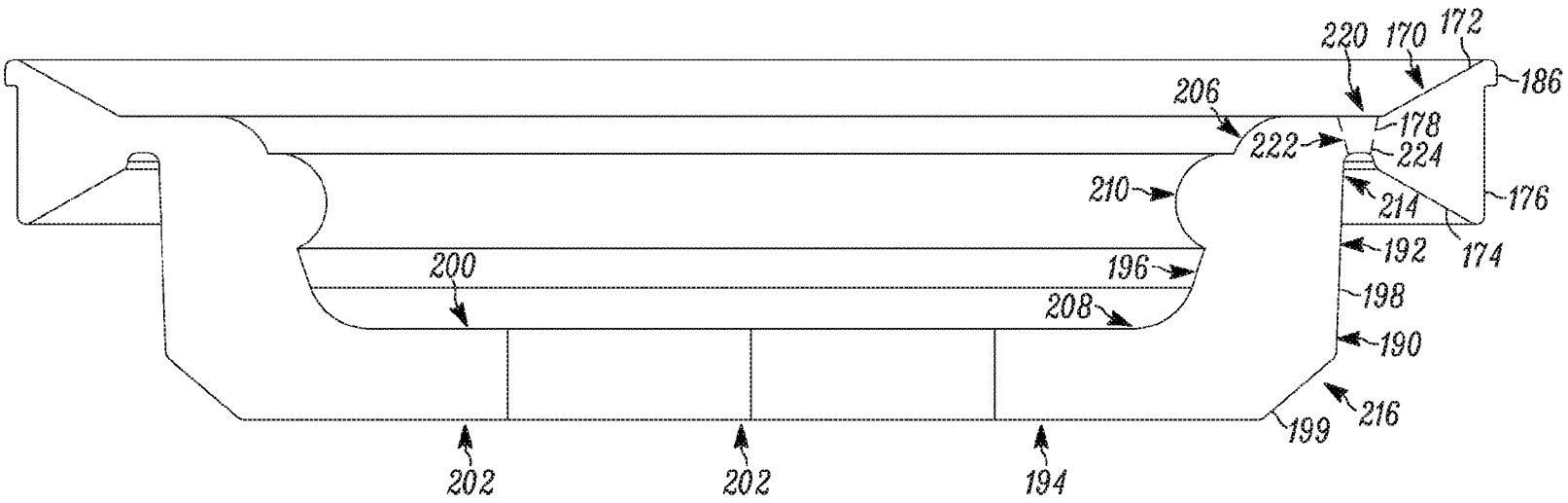
FIG. 14 of the drawings is a cross-sectional view of the sealing membrane of the present disclosure.
Figure 15:
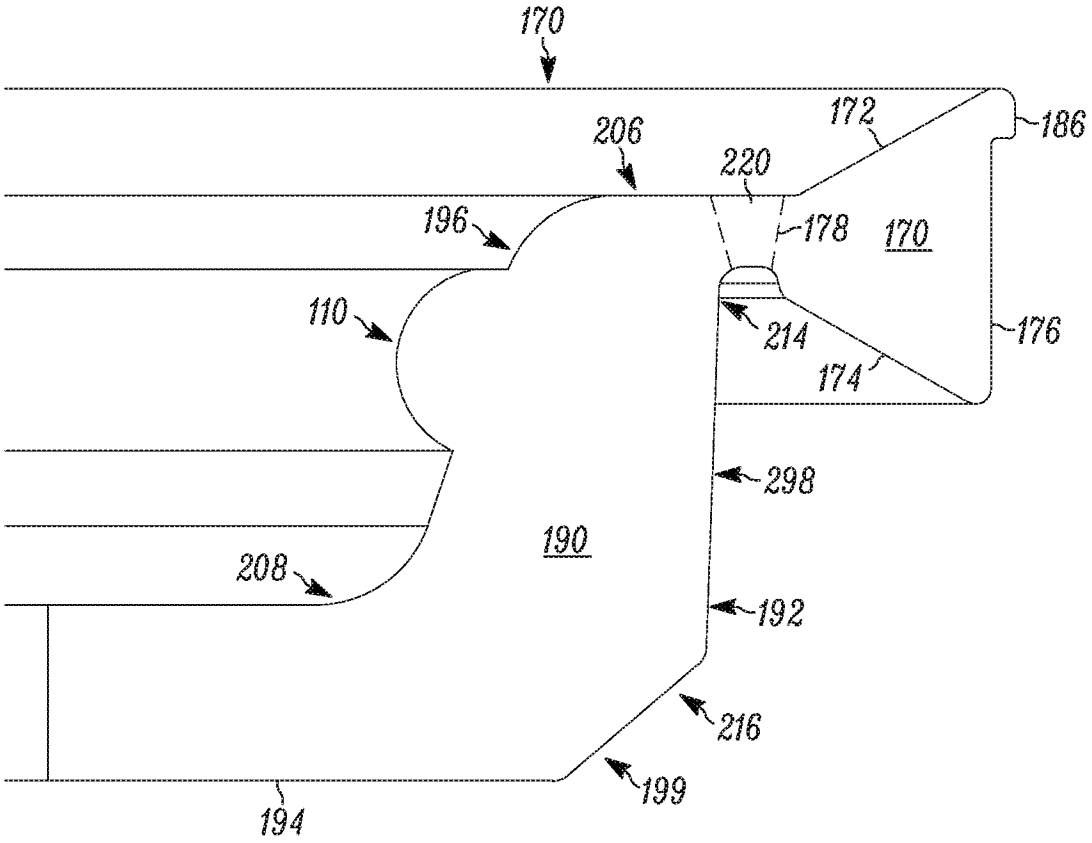
FIG. 15 of the drawings is a partial cross-sectional view of the sealing membrane of the present disclosure, showing, in particular, the features of the body attachment flange, the connector region and the sidewall structure of the valve body.

With reference to FIGS. 13 through 15, sealing membrane 142 is shown as comprising body attachment flange 170, valve body 190 and connector region 220. The sealing membrane comprises a silicone polymer material, although other materials are likewise contemplated for use. Such materials include, but are not limited to natural and synthetic rubbers and low durometer polymers. Generally the sealing membrane has a generally circular circumferential configuration with the body attachment flange having an annular configuration. Of course, the outer perimeter configuration is not limited to a substantially circular configuration, and other shapes are contemplated for use.

With further reference to FIG. 12, the body attachment flange 170 comprises upper seal surface 172, lower seal surface 174, outer seal surface 176 and connector coupling interface 178. The body attachment flange has a substantially triangular cross-sectional configuration. In such a configuration the outer seal surface 176 is substantially vertically oriented, and includes an upper flange 186 which extends outwardly from the upper end thereof. The connector coupling interface 178 is spaced apart from, and inward of, the outer seal surface 176. The upper seal surface 172 extends across the upper ends of the outer seal surface 176 and the connector coupling interface 178. The lower seal surface 174 extends across the lower ends of the outer seal surface 176 and the connector coupling interface 178.

As will be explained, the outer seal surface 176 seals against membrane engagement surface 169. Additionally, the lower seal surface 174 sealingly engages membrane engaging flange 166. Finally, the upper seal surface sealingly engages the sealing membrane engaging surface 282 of the retaining ring 144. The ring compresses the body attachment flange 170 against the membrane engaging flange 166 and the natural resilience of the material forms a substantially fluid tight seal.

With reference to FIGS. 14 and 15, the valve body 190 is shown as comprising a substantially cup-like shaped member. The valve body includes sidewall structure 192 and base wall structure 194. In the embodiment shown, the sidewall structure 192 comprises a substantially annular hoop-like member with the base wall structure 194 spanning within the confines of the sidewall structure.

The sidewall structure 192 comprises inner surface 196 and outer surface 198. The inner surface includes upper end 206 and lower end 208. The inner surface slopes inwardly from the upper end 206 to the lower end 208. Inward protrusion 210 is disposed between the upper end and the lower end. The inward protrusion, in the embodiment shown, comprises an annular bump with a substantially hemispherical cross-sectional configuration. Of course, other configurations are contemplated. The inward protrusion helps to direct the probe toward the valve opening 204, and provides an additional measure of strength to the sidewall to preclude damage to the sealing membrane during insertion of the probe.

The outer surface 198 of the sidewall structure 192 includes upper end 214 and lower end 216. Generally the outer surface is substantially perpendicular to the base wall structure 194. In the embodiment shown, the outer surface 198 substantially tracks the membrane engaging flange 166 in a spaced apart orientation therefrom, and in particular, the outer surface 198 is inclined slightly inwardly. The lower end 216 of the outer surface 198 may include a chamfer 199 which substantially matches the surface variation of the membrane engaging flange 166.

The sidewall structure 192 has a greater thickness at the lower end 208, 216 of the inner surface 196 and the outer surface 198, respectively, than at the upper ends thereof. As such, deformation of the lower end of the sidewall structure is minimized relative to the top thereof, and the additional thickness provides further cushioning if the probe is inserted in a manner that is not directed at the valve opening 204.

With reference to FIGS. 13 through 15, the base wall structure 194 includes inner surface 200, outer surface 202 and valve opening 204. The inner surface 200 is spaced apart from the outer surface such that the base wall structure 194 is of a substantially uniform thickness inboard of the sidewall structure 192.

The valve opening 204 comprises a plurality of slits that are configured to separate and to sealingly engage a probe inserted therethrough. Typically, with the materials that are contemplated for the sealing membrane, upon removal of the probe, the material rejoins such that the slits substantially preclude the passage therethrough of fluid. In the embodiment shown, a substantially snowflake like configuration is shown, which is well suited to the grasping and sealingly engaging a probe of, for example, a cylindrical configuration.

The connector region 220 is shown in FIG. 12 as comprising an inner interface 222 and an outer interface 224. The inner interface 222 engages the sidewall structure 192 of the valve body 190. The outer interface 224 extends from the sealing membrane, and in particular from the connector coupling interface 178. The outer interface 224 is spaced apart from the lower end of the lower seal surface 174 so as to form a channel which insures that contact of the connector region with the membrane engaging flange can be minimized.

With reference to FIG. 12, retaining ring 144 comprises a hoop-like structure which has body engaging tab 280, sealing membrane engagement surface 282 and inner wall structure 284. The tab 280 is shown as comprising a projection extending outwardly about the outside perimeter of the retaining ring.

The tab 280 is configured to be insertable and restrainable within the recessed channel 167. With the tab inserted within the channel 167, the body attachment flange 170 of the sealing membrane 142 becomes compressed so as to form a fluid-tight seal between the lower seal surface 176 of the sealing membrane 142 and the membrane engagement flange 166 of opening 154. In particular, the ring presses against the membrane so that its base surface presses against the body attachment flange and the upper seal surface 172 engages the seal membrane engagement surface 282. The natural resilience of the sealing membrane allows for the sealed engagement against the ring and the body. Typically, the seal membrane engagement surface includes a surface area which engages a similarly configured surface area on the membrane itself. The surface area of engagement is such that a significant seal can be created therebetween.

The inner wall structure 284 is configured to preclude damage to the membrane proximate the engagement of the membrane with the membrane engagement flange 166. Typically, the bags associated with the present cap assembly, when full, may have a weight of, for example 25 pounds or the like. As such, when dropped onto a probe-type dispenser that is designed to extend through the membrane, damage to the membrane is of heightened concern. It has been found that the potential for damage to the membrane is greatly reduced with the presently configured inner wall structure 284. The inner wall structure 284 includes a inwardly sloping protective flange 286 that extends over a portion of the membrane and extends radially inwardly beyond the inward projection of the membrane engagement flange 166. The inwardly sloping protective flange terminates with a substantially planar wall 187 which is substantially parallel to a longitudinal axis of the opening.

In such a configuration, a downwardly projecting probe may hit the inner wall structure 184 which will direct the probe inwardly toward the membrane. As the probe is directed to the membrane, the engagement of the probe with the membrane occurs at a point that is spaced apart from the membrane engagement flange 166 and thus, an additional measure of give is observed. The inwardly sloping angle is configured to slope inwardly at an acute angle of approximately 20° to 50°, however, the invention is not limited thereto.

Furthermore, the configuration of the membrane enhances the ability to withstand impacts from the downwardly projecting probe. The sidewall structure and the connector region are configured to both deflect and to direct the probe toward the valve opening. In particular, the inner surface 196 is inclined inwardly to urge the probe toward the valve opening. Additionally, the lower portions of the sidewall structure have less deflection, due to the greater thickness to further urge the probe toward the valve opening. Further still, the greater thickness and the inward protrusion further provide additional protection to the membrane to promote the integrity of the membrane.

Figure 16:
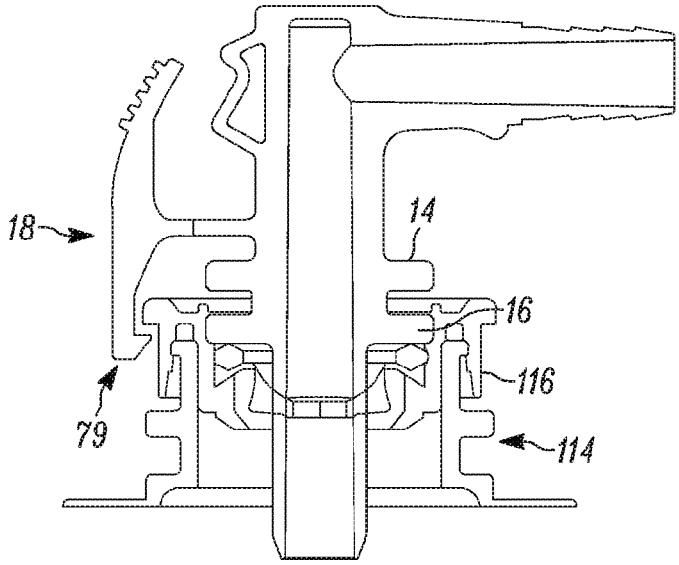
FIG. 16 of the drawings is a cross-sectional view of a connector having a lockout collar properly interfacing with a spout and cap.

Turning now to FIG. 16, the connector assembly 10 (without the lockout collar) is shown as being inserted into the cap member 116, and in particular, through valve opening 204 of the sealing membrane. As is shown, as the inserted portion extends beyond the sealing membrane, eventually, the lower flange 16 hits the retaining ring 144 and the bottom surface 56 thereof abuttingly engages the retaining ring 144, as the configuration of the lower flange substantially corresponds to the shape of the inner surface 164. As such, when fully inserted, the flange maintains the second elongated portion of the body of the connector in the proper central position, thereby enhancing the sealing configuration. It will also be understood that the portion of the inserted member that cooperates with the sealing membrane is preferably rigid and substantially uniformly smooth so as to facilitate the proper sealing therewith.

It should be noted that in the fully engaged configuration, the locking membrane has been directed into the outer flange of the cap, wherein the outer flange pushed against the outer surface of the cap engaging portion to direct the outer flange of the cap beyond the inward flange and toward the central pivot beam. The configuration of the inner surface of the inward flange precludes passage of the outer flange in the opposite direction without manipulating the handle portion of the locking mechanism to rotate the inward flange away from the outer flange and beyond the outer flange. At such time, the outer flange can be directed beyond the inward flange, as the connector is disengaged.

Figure 17:
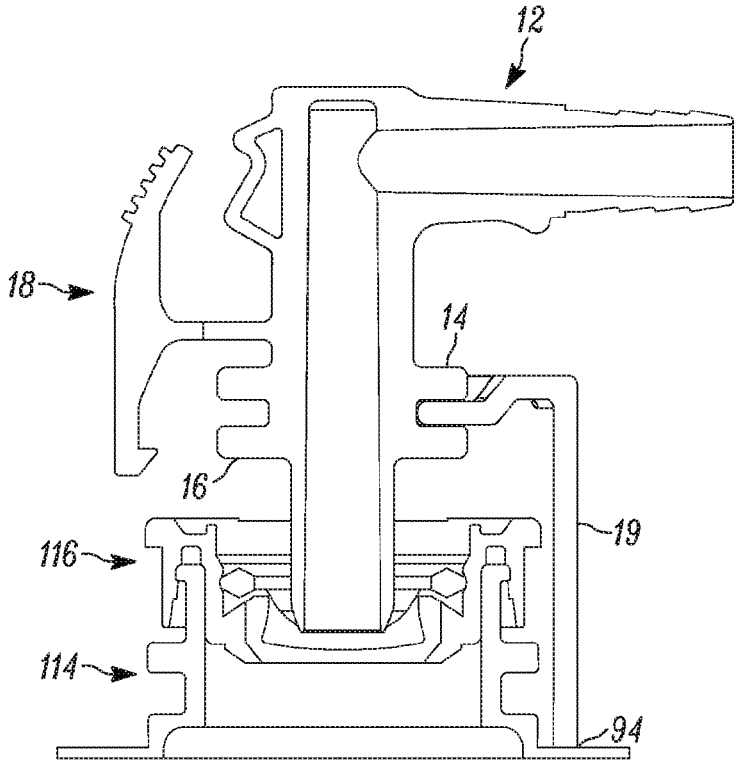
FIG. 17 of the drawings is a cross-sectional view of a connector having a lockout collar that precludes interfacing with a spout and cap.

With respect to FIG. 17, a configuration is shown wherein the lockout collar 19 precludes the insertion of the distal end of the second elongated portion beyond the sealing membrane. Such a lockout collar precludes the inadvertent and incorrect coupling of a connector assembly with a cap (or flexible bag) for which such a coupling is deemed not desirable. As can be seen, as long as the distance between the distal end of the second elongated portion and the distal end of the extension portion of the lockout collar is greater than the distance between the base of the spout and the sealing membrane, the lockout collar will preclude the coupling of the connector to the cap and spout.

Figure 18:
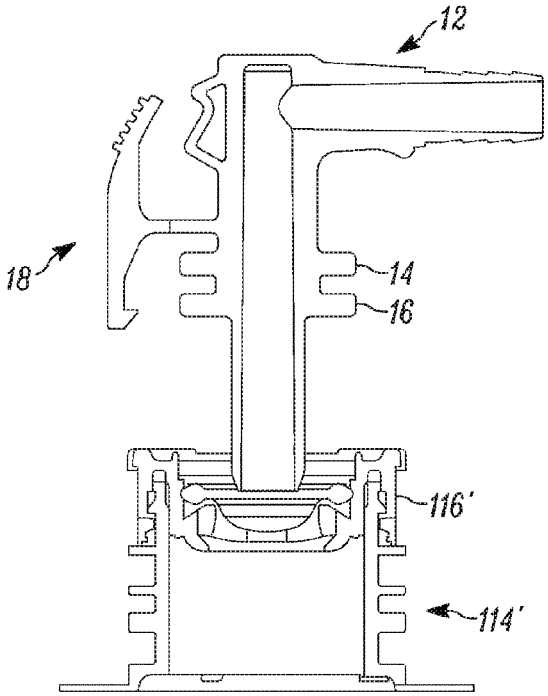
FIG. 18 of the drawings is a cross-sectional view of a connector precluded from interfacing with a spout and cap due to the relative size of the opening of the retaining ring versus the connector.

With respect to FIG. 18, such a configuration shows a retaining ring which has an opening that is smaller than the second elongated portion. In such a configuration, the second elongated portion is precluded from contact with and passage through the sealing membrane. Such a configuration is quite useful to preclude inadvertent cooperation between connectors and flexible bags with which such coupling is not desired.

Figure 19:
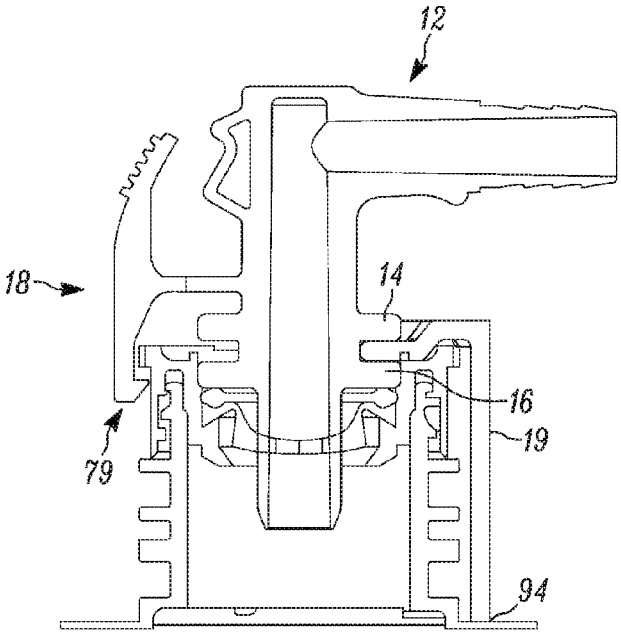
FIG. 19 of the drawings is a cross-sectional view of a connector interfacing with a spout and cap.

With respect to FIG. 19, the configuration shows the engagement of the connector of FIG. 17 with a spout and cap with which engagement is desired. In particular, the distance between the base of the spout and the sealing membrane is greater than the distance between the distal end of the second elongated portion of the connector and the distal end of the extension portion of the lockout collar. Thus, before the distal end 94 of the extension portion reaches the base of the spout (i.e., the base flange), the distal end of the second elongated portion has contacted the sealing membrane and extended therethrough.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A connector for a self sealing fitment attachable to a spout, the self sealing fitment further comprising:

body having an elongated opening extending from a top end to a bottom end, the opening including an inner surface, the body further including an axially outward flange positioned along an outer surface of the body;

a sealing membrane extending across the opening in a sealing configuration, the membrane spaced apart from the top end and the bottom end and including a valve opening extending therethrough;

a retaining ring attachable to the body along the inner surface of the opening, and positionable so as to sealingly sandwich the sealing membrane between the body and the retaining ring, with the ring positioned between the axially outward flange and the sealing membrane;

the connector further comprising:

a body having a first elongated portion and a second elongated portion, each having an inner passageway, with the inner passageways being in fluid communication with each other, the first elongated portion having a proximal end that meets with a proximal end of the second elongated portion, the second elongated portion having an outer surface, the second elongated portion extends to a distal end, with the second elongated portion being smaller than the elongated opening of the body, so that when the second elongated portion is positioned within the elongated opening of the body, the second elongated portion is axially spaced apart from the body;

a lower flange disposed on the outer surface of the second elongated portion, the lower flange spaced apart from the distal end, wherein the lower flange defines the insertion portion of the second elongated portion as the region extending from the lower flange to the distal end, the lower flange being smaller than the elongated opening of the body of the self sealing fitment; and a locking mechanism having a central pivot beam extending outwardly from the second elongated portion between the proximal end and the lower flange, a movable portion extending from the central pivot beam in a first direction toward the proximal end of the second elongated portion defining a handle portion, and in a second direction toward the distal end of the second elongated portion defining an engaging portion, both the handle portion and the engaging portion having an inner surface facing and spaced apart from the second elongated portion, with an inward flange positioned at a distal end of the cap engaging portion, whereupon insertion of the connector into the self sealing fitment, the insertion portion extends through the valve opening of the sealing membrane, with the lower flange extending into the elongated opening of the body of the self sealing fitment, so as to maintain the insertion portion in a spaced apart configuration relative to the inner surface of the elongated opening of the body of the self sealing fitment, with the lower flange of the second elongated portion extending into the elongated opening of the body of the self sealing fitment, and inwardly beyond the axially outward flange, with the inward flange of the locking mechanism cooperatively engaging the axially outward flange of the body of the self sealing fitment to preclude inadvertent detachment of the connector from within the self sealing fitment and with the lower flange centering the second elongated portion within the elongated opening, and, maintaining the second elongate portion in the spaced apart orientation from the elongated opening of the self sealing fitment.

2. The connector of claim 1 wherein, the insertion portion of the outer surface of the second elongated portion having a substantially uniformly smooth surface configuration structurally configured to sealingly engage the valve opening of the sealing membrane.

3. The connector of claim 2 wherein the insertion portion of the outer surface of the second elongated portion is free of resilient sealing members or o-rings.

4. The connector of claim 1 wherein the lower flange includes a bottom surface, the bottom surface contacting one of the retaining ring and the sealing membrane when the inward flange of the locking mechanism cooperatively engages the axially outward flange of the body of the self sealing fitment.

5. The connector of claim 1 wherein the first elongated portion and the second elongated portion are substantially perpendicular to each other.

6. The connector of claim 1 comprising a single integrally molded member.

7. The connector of claim 6 wherein the single integrally molded member comprises a uniform material therethrough.

8. The connector of claim 1 wherein the lower flange includes a bottom surface that is substantially perpendicular to the second elongated portion.

9. The connector of claim 1 wherein the locking mechanism further includes a pivot stop positioned between the central pivot beam and the proximal end of the second elongated portion, the pivot stop precluding further pivoting of the central pivot beam relative to the second elongated member.

10. The connector of claim 1 further including a lockout collar having a radially outward portion extending radially outward from the second elongated portion proximate the lower flange, an extension portion extending from the radially outward portion in an annular configuration around at least a portion of the second elongated portion in a direction toward the distal end of the second elongated portion, the second elongated portion being longer than the outer surface of the body of the self sealing fitment.

11. The connector of claim 10 wherein the body further includes an upper flange spaced apart from the lower flange toward the proximal end of the second elongated portion, a channel defined between the upper flange and the lower flange, the lockout collar further including a connector body coupling member extending from the radially outward portion, the connector body coupling member configured to releasably engage with the second elongated portion within the channel defined between the upper flange and the lower flange.

12. The connector of claim 11 wherein the extension portion extends arcuatly approximately 180° about the second elongated portion.

13. The connector of claim 12 wherein the extension portion is substantially parallel with the second elongated portion.

14. The connector of claim 13 wherein the extension portion extends beyond the distal end of the second elongated portion.

15. The connector of claim 1 further comprising a valve positioned within the second inner passageway proximate the distal end of the second elongated portion in a configuration to preclude material from passing beyond the valve and through the distal end.

16. The connector of claim 15 wherein the valve comprises a duck bill valve, wherein a clamping member is attachable to the distal end of the second elongated portion, whereupon attachment, sandwiches a portion of the duck bill valve therebetween, to in turn, fix the position of the valve within the second elongated portion.

17. The connector of claim 16 wherein the clamping member includes a interfacing tab, and the distal end of the second elongated portion includes an interfacing tab, wherein the interfacing tab of the clamping member and the interfacing tab of the second elongated portion are configured for coupling with each other.

* * * * *